US012180635B2

(12) United States Patent
Lee et al.

(10) Patent No.: US 12,180,635 B2
(45) Date of Patent: Dec. 31, 2024

(54) LAUNDRY TREATING APPARATUS AND METHOD FOR CONTROLLING THE SAME

(71) Applicant: LG ELECTRONICS INC., Seoul (KR)

(72) Inventors: Sunho Lee, Seoul (KR); Youngjong Kim, Seoul (KR); Dongcheol Kim, Seoul (KR); Junghyun Park, Seoul (KR); Unkeol Yeo, Seoul (KR); Hyeyong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 565 days.

(21) Appl. No.: 17/401,731

(22) Filed: Aug. 13, 2021

(65) Prior Publication Data

US 2022/0049394 A1 Feb. 17, 2022

(30) Foreign Application Priority Data

Aug. 14, 2020 (KR) ..... 10-2020-0102607
Aug. 14, 2020 (KR) ..... 10-2020-0102610

(51) Int. Cl.
*D06F 33/38* (2020.01)
*D06F 17/10* (2006.01)
(Continued)

(52) U.S. Cl.
CPC ..... *D06F 33/38* (2020.02); *D06F 17/10* (2013.01); *D06F 23/04* (2013.01); *D06F 33/32* (2020.02);
(Continued)

(58) Field of Classification Search
CPC ..... D06B 23/10; D06F 23/04; D06F 37/40; D06F 39/088; D06F 2105/48; D06F 33/32; D06F 33/37; D06F 33/38; D06F 17/10; D06F 39/02; D06F 39/022; D06F 2105/02; D06F 2105/42
See application file for complete search history.

(56) References Cited

U.S. PATENT DOCUMENTS 4,054,412 A * 10/1977 Brummett ..... D06F 37/24 8/158
4,622,708 A * 11/1986 Gaelic ..... D06F 13/02 68/53
(Continued)

FOREIGN PATENT DOCUMENTS

EP 3412822 B9 * 12/2018 ..... D06F 23/02
KR 20110072974 * 12/2009 ..... D06F 39/02
(Continued)

*Primary Examiner* — Joseph L. Perrin
(74) *Attorney, Agent, or Firm* — Fish & Richardson P.C.

(57) ABSTRACT

A laundry treating apparatus includes a cabinet, a tub, a drum, a rotator including a bottom portion positioned on a bottom surface of the drum, a pillar protruding from the bottom portion toward an open surface of the drum, and blades spaced apart from one another along a circumferential direction of the pillar and inclined with respect to a longitudinal direction of the pillar, a water supply, a sprayer, a drainage, and a controller for controlling rotation of the drum and the rotator and operation of the water supply and the drainage. During a rinsing operation, the drum and the rotator rotate in a same direction while water is continuously sprayed through the sprayer and the drainage is closed.

10 Claims, 15 Drawing Sheets

(51) Int. Cl.

| | |
|---|---|
| ***D06F 23/04*** | (2006.01) |
| ***D06F 33/32*** | (2020.01) |
| ***D06F 37/40*** | (2006.01) |
| ***D06F 39/02*** | (2006.01) |
| ***D06F 39/08*** | (2006.01) |
| *D06F 33/37* | (2020.01) |
| *D06F 105/02* | (2020.01) |
| *D06F 105/42* | (2020.01) |
| *D06F 105/48* | (2020.01) |

(52) U.S. Cl.

CPC ..... *D06F 37/40* (2013.01); *D06F 39/02* (2013.01); *D06F 39/088* (2013.01); *D06F 33/37* (2020.02); *D06F 39/022* (2013.01); *D06F 2105/02* (2020.02); *D06F 2105/42* (2020.02); *D06F 2105/48* (2020.02)

(56) References Cited

U.S. PATENT DOCUMENTS

| | | | | |
|---|---|---|---|---|
| 10,214,846 | B2 * | 2/2019 | Song | D06F 37/40 |
| 2015/0114046 | A1 * | 4/2015 | Jeong | D06F 39/088 68/17 R |

FOREIGN PATENT DOCUMENTS

| | | | | |
|---|---|---|---|---|
| KR | 20110067469 | * | 6/2011 | D06F 33/38 |
| KR | 20210097456 | * | 1/2020 | D06F 33/76 |
| KR | 20210097458 | * | 1/2020 | D06F 33/76 |

* cited by examiner

LAUNDRY TREATING APPARATUS AND METHOD FOR CONTROLLING THE SAME

CROSS-REFERENCE TO RELATED APPLICATIONS

This application claims the benefit of Korean Patent Application No. 10-2020-0102610, filed on Aug. 14, 2020, and Korean Patent Application No. 10-2020-0102607, filed on Aug. 14, 2020, which are hereby incorporated by reference as if fully set forth herein.

BACKGROUND

Field

The present disclosure relates to a laundry treating apparatus, and more particularly, to a laundry treating apparatus having a rotator disposed in a drum.

Discussion of the Related Art

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Korean Patent No. 10-0186729 discloses a laundry treating apparatus including a rotator disposed inside a drum. The laundry treating apparatus improves a washing efficiency by rotating the rotator to form a water flow.

An efficient design is required for the rotator such that the water flow formed by the rotation may improve the washing efficiency. Furthermore, a design that may effectively reduce a load on a motor by effectively reducing a load on the rotation of the rotator is required.

Therefore, it is an important task in the art to design the rotator such that the rotator may rotate to effectively improve the washing efficiency and the load on the rotation of the rotator may be effectively reduced.

SUMMARY

According to embodiments of the present disclosure, an object of the present disclosure is to provide a laundry treating apparatus and a method for controlling the same capable of securing a rinsing performance while an amount of water used is small and a rinsing time is minimized.

Another object of the present disclosure is to provide a laundry treating apparatus and a method for controlling the same that allow a fabric softener to be present in the laundry treating apparatus for a long time.

As an example for solving the above-described problem, provided are a laundry treating apparatus and a method for controlling the same that may perform rinsing while spraying water in a state in which a drainage is closed.

In addition, provided are a laundry treating apparatus and a method for controlling the same that may secure a rinsing performance while RPMs of a drum and a rotator are repeatedly increased and reduced.

According to a first aspect of the present disclosure, provided is a method for controlling a laundry treating apparatus including a cabinet, a tub for providing therein a space for water to be stored, a drum rotatably disposed inside the tub, wherein the drum includes an open surface for inserting and withdrawing clothes therethrough and a bottom surface located on an opposite side of the open surface, a rotator including a bottom portion positioned on the bottom surface, a pillar protruding from the bottom portion toward the open surface, and a plurality of blades disposed to be spaced apart from each other along a circumferential direction of the pillar, wherein the blade extends from a side of the bottom portion to a side of the open surface along a direction inclined with respect to a longitudinal direction of the pillar, wherein the rotator is rotatably installed on the bottom surface and inside the drum, a water supply for supplying water into the tub, a sprayer for receiving water from the water supply and spraying water into the drum, a drainage for draining water in the tub to the outside of the cabinet, and a controller for controlling rotation of the drum and the rotator and operation of the water supply and the drainage including a fabric softener input operation of injecting a fabric softener into the drum through water supplied from the water supply, a water spray operation of spraying water into the drum through the sprayer while the drainage is closed after the fabric softener input operation is terminated, and a rinsing rotation operation of rotating the drum and the rotator in the same direction while continuously spraying water from the sprayer with the drainage closed.

In one implementation of the first aspect, the rinsing rotation operation may be controlled such that an RPM of the drum and the rotator is varied.

In one implementation of the first aspect, the drum and the rotator may be controlled in the rinsing rotation operation such that a first rotation forming an ascending water flow is performed and a second rotation forming a descending water flow is performed after the first rotation, and the drum and the rotator may perform the first rotation and the second rotation in an alternating manner in the rinsing rotation operation.

In one implementation of the first aspect, the RPM of the drum and the rotator may be increased and decreased repeatedly in the rinsing rotation operation.

In one implementation of the first aspect, a drain operation and a dehydration operation may be performed after the rinsing rotation operation is performed.

According to a second aspect of the present disclosure, provided is a laundry treating apparatus including a cabinet, a tub for providing therein a space for water to be stored, a drum rotatably disposed inside the tub, wherein the drum includes an open surface for inserting and withdrawing clothes therethrough and a bottom surface located on an opposite side of the open surface, a rotator including a bottom portion positioned on the bottom surface, a pillar protruding from the bottom portion toward the open surface, and a plurality of blades disposed to be spaced apart from each other along a circumferential direction of the pillar, wherein the blade extends from a side of the bottom portion to a side of the open surface along a direction inclined with respect to a longitudinal direction of the pillar, wherein the rotator is rotatably installed on the bottom surface and inside the drum, a water supply for supplying water into the tub, a sprayer for receiving water from the water supply and spraying water into the drum, a drainage for draining water in the tub to the outside of the cabinet, and a controller for controlling rotation of the drum and the rotator and operation of the water supply and the drainage, wherein, during rinsing, the drum and the rotator are rotated in the same direction while water is continuously sprayed from the sprayer with the drainage closed.

In one implementation of the second aspect, when water is continuously sprayed from the sprayer with the drainage closed, an RPM of the drum and the rotator may be varied.

In one implementation of the second aspect, a controller may control the drum and the rotator such that a first rotation forming an ascending water flow is performed and a second rotation forming a descending water flow is performed after the first rotation, and the drum and the rotator may perform the first rotation and the second rotation in an alternating manner.

In one implementation of the first aspect, the RPM of the drum and the rotator may be increased and decreased repeatedly.

In one implementation of the second aspect, the controller may control the drainage such that drainage of discharging water in the tub out of the cabinet is performed after the rinsing is completed, and the controller may control the driver such that dehydration is performed after the drainage is completed.

According to embodiments of the present disclosure, the rinsing performance may be secured while using the amount of water smaller than that in the deep rinse scheme.

In addition, the rinsing may be performed while evenly distributing the cloths.

In addition, even when the rinsing is performed using the sprayer, it is possible to prevent the phenomenon in which the drum is filled with the water by adjusting the rpm of the drum and the rotator.

DESCRIPTION OF SPECIFIC EMBODIMENTS

Hereinafter, a specific embodiment of the present disclosure will be described with reference to the drawings. A following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of the prior art related to the present disclosure may unnecessarily obscure the gist of the present disclosure, the detailed description thereof will be omitted. In addition, terms to be described later are terms defined in consideration of functions in the present disclosure, which may vary based on intentions of users and operators, customs, or the like. Therefore, a definition thereof should be made based on a content throughout this specification. The terminology used in the detailed description is for the purpose of describing embodiments of the present disclosure only, and should not be limiting. As used herein, the singular forms 'a' and 'an' are intended to include the plural forms as well, unless the context clearly indicates otherwise. It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

Figure 1:
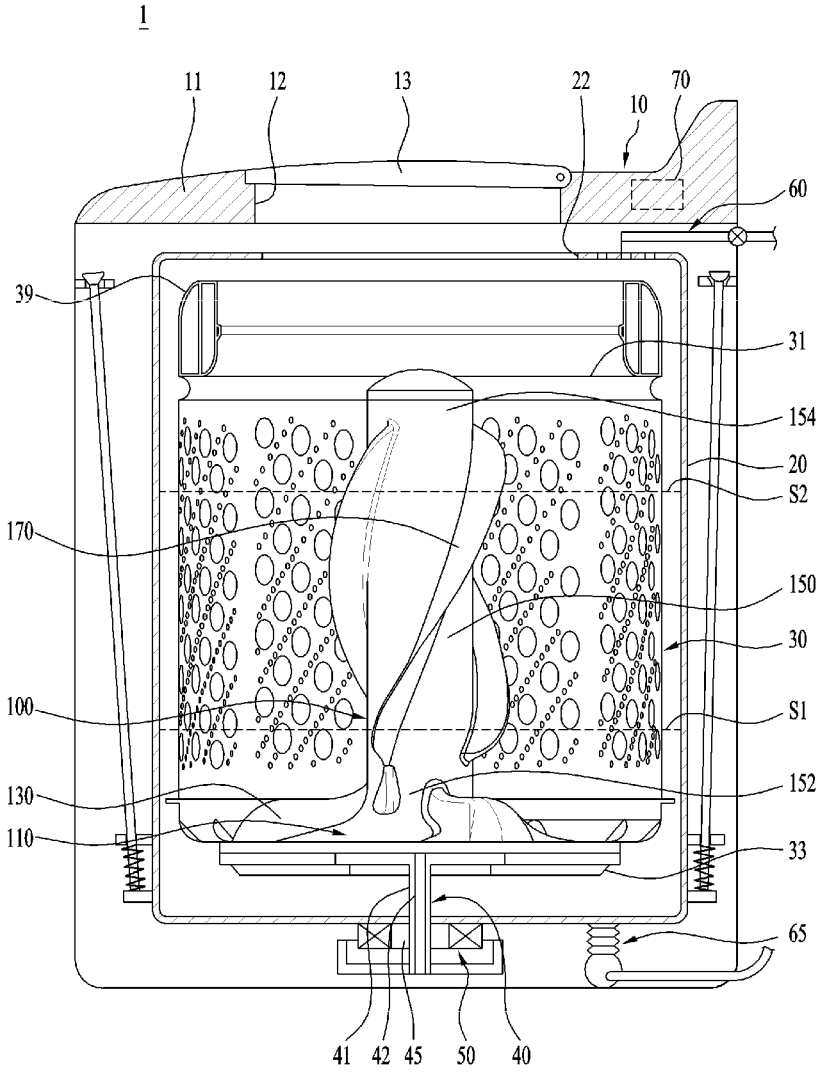
FIG. 1 is a view showing an interior of a laundry treating apparatus according to an embodiment of the present disclosure.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10, and a laundry door 13 for opening and closing the laundry inlet 12 is disposed on the top surface 11 according to an embodiment of the present disclosure. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a support of the tub 20. The support of the tub 20 may be in a structure capable of damping vibrations generated in the tub 20.

The tub 20 is supplied with water through a water supply 60. The water supply 60 may be composed of a water supply pipe that connects a water supply source with the tub 20, and a valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drainage 65. The drainage 65 may be composed of a drain pipe that guides the water inside the tub 20 to the outside of the cabinet 10, a drain pump disposed on the drain pipe, and a drain valve for controlling opening and closing of the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The drum 30 may have an opening of the drum 30 defined therein positioned below the tub opening 22 to communicate with the inlet. One surface of the drum 30 may be opened to define an open surface 31 as will be described later, and the open surface 31 may correspond to the opening of the drum 30.

A plurality of through-holes of the drum 30 that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the through-holes of the drum 30.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface 33 of the tub 20. In this case, the laundry inlet 12 may be defined in the top surface 11 of the cabinet 10, the tub opening 22 may be defined in the top surface of the tub 20, and the opening of the drum 30 may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20. The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be constructed to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like. For example, the controller 70 can include an electric circuit or a processor.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
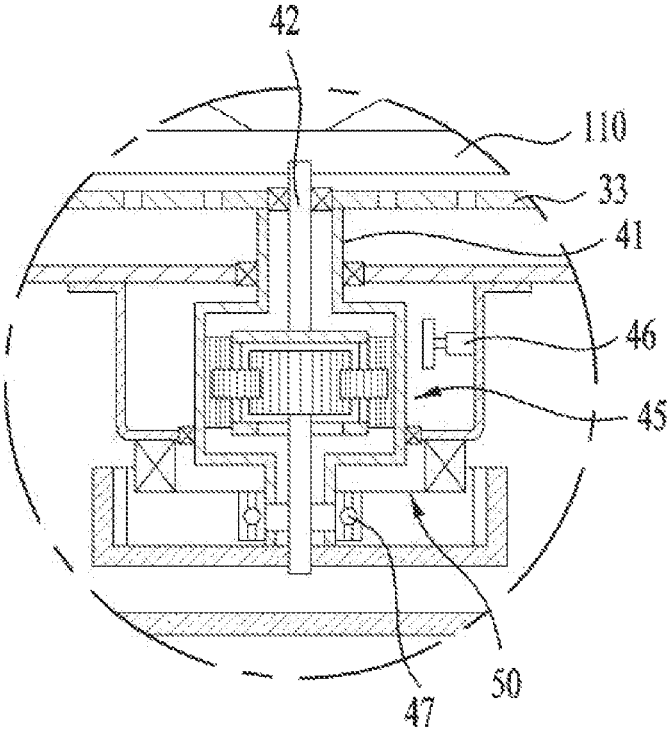
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a first rotation shaft 41 is coupled to the bottom surface 33 thereof, and the rotator 100 may be rotated by being coupled to a second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 41 connected to the ring gear.

The second clutch element 47 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 47.

In one embodiment of the present disclosure, when the first clutch element 46 and the second clutch element 47 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 41, and the second rotation shaft 42 are all in the stationary state. The controller 70 may implement a necessary driving state by appropriately controlling the driver 50, the first clutch element 46, the second clutch element 47, and the like in the washing process, the rinsing process, and the like.

Figure 3:
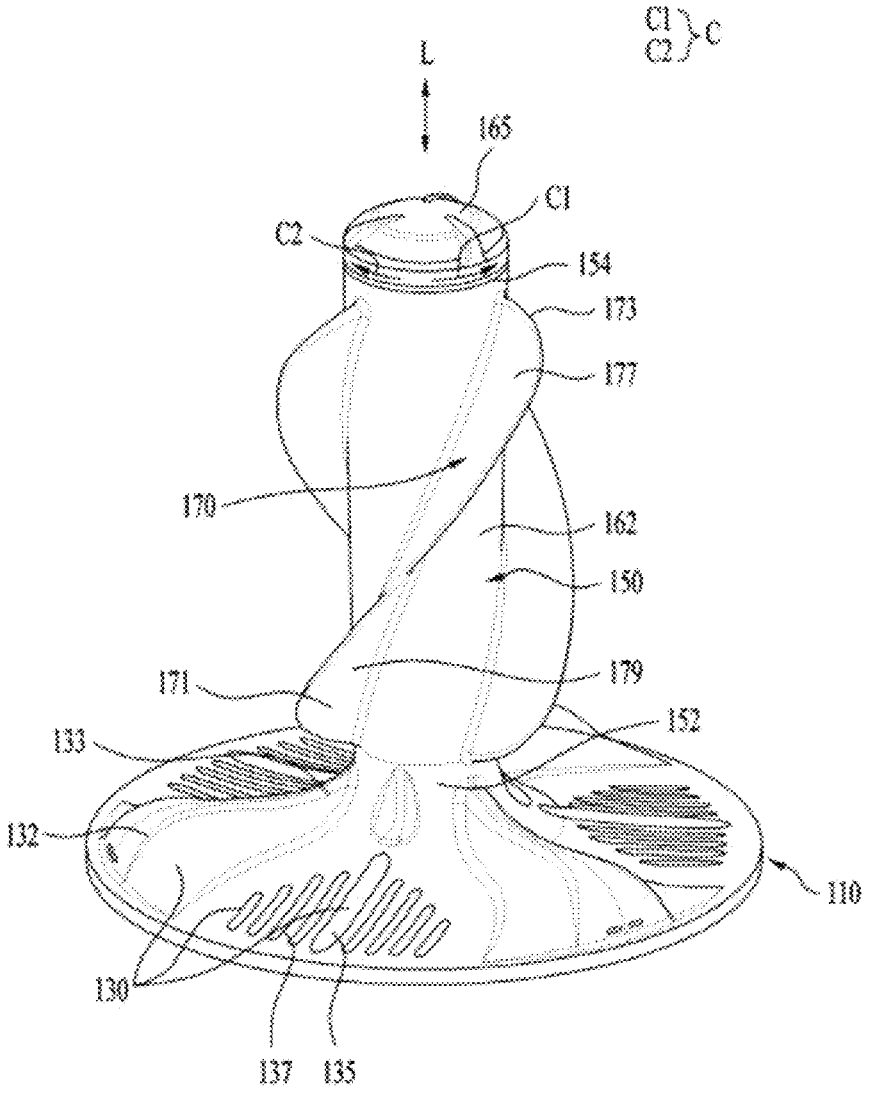
FIG. 3 is a perspective view illustrating a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface 33 of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height L1 from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from a side of the bottom portion 110 to a side of the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances between the blades 170 may be the same. When viewed from the open surface 31 of the drum 30, the blades 170 may be spaced apart from each other at an angle of 120 degrees with respect to a center O of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length L3 of the blade 170 may be varied as needed.

As the blade 170 extends obliquely, when the rotator 100 is rotated, an ascending or descending water flow may be formed in the water inside the drum 30 by the blade 170 of the pillar 150.

For example, when the blade 170 extends from the bottom portion 110 toward the open surface 31 while being inclined with respect to one direction C1 among the circumferential directions C of the pillar 150, the descending water flow may be formed by the inclined shape of the blade 170 when the rotator 100 rotates in said one direction C1, and the ascending water flow may be formed by the blade 170 when the rotator 100 is rotated in the other direction C2.

In one embodiment of the present disclosure, said one direction C1 and the other direction C2 of the circumferential direction C of the pillar 150 may correspond to directions opposite to each other with respect to the outer circumferential surface 162 of the pillar 150, and may be a direction perpendicular to the longitudinal direction L of the pillar 150.

Said one direction C1 and the other direction C2 of the circumferential direction C of the pillar 150 may correspond to the rotation direction of the rotator 100. Because the rotation direction of the rotator 100 and the circumferential direction C of the pillar 150 are parallel to each other, the rotator 100 may be rotated in said one direction C1 or rotated in the other direction C2.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction C of the pillar 150, and may extend in the form of the screw from one end 171 facing the bottom portion 110 to the other end 173 facing the open surface 31.

In other words, in one embodiment of the present disclosure, the plurality of blades 170 may extend while being wound on the outer circumferential surface 162 from said one end 152 facing the bottom portion 110 to the other end 154 facing the open surface 31.

In one example, when referring to FIG. 3, in one embodiment of the present disclosure, the blade 170 may be inclined in said one direction C1 among the circumferential directions C of the pillar 150 with respect to the longitudinal direction L of the pillar 150, and may extend from said one end 171 to the other end 173.

That is, the blade 170 may be constructed to be inclined in only said one direction C1 and not to be inclined in the other direction C2. When the inclination direction of the blade 170 is changed to the other direction C2 during the extension, during the rotation of the rotator 100, a portion of the blade 170 may generate the ascending water flow and the remaining portion may generate the descending water flow.

In this case, the ascending water flow and the descending water flow may occur simultaneously in the rotation of the rotator 100 in said one direction C1, so that it may be difficult to maximize the effect of either ascending or descending of the water.

Accordingly, in one embodiment of the present disclosure, the blade 170 extends obliquely with respect to the longitudinal direction L of the pillar 150, and extends obliquely to said one direction C1 among the circumferential directions C of the pillar 150, so that water flow characteristics for the rotation of the rotator 100 in said one direction C1 and the other direction C2 may be maximized. Said one direction C1 may be one of a clockwise direction and a counterclockwise direction, and the other direction C2 may be the other one.

In one example, in one embodiment of the present disclosure as shown in FIG. 3, the blade 170 may continuously extend from said one end 171 to the other end 173. That is, the blade 170 may be continuously extended without being cut between said one end 171 and the other end 173.

In addition, the blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

When at least a portion of the blade 170 is parallel to the longitudinal direction L or the circumferential direction C of the pillar 150, it may be disadvantageous to forming the ascending water flow or the descending water flow resulted from the rotation of the pillar 150. Accordingly, in one embodiment of the present disclosure, the blade 170 may be inclined with respect to the longitudinal direction L of the pillar 150 over an entire length L2.

Figure 4:
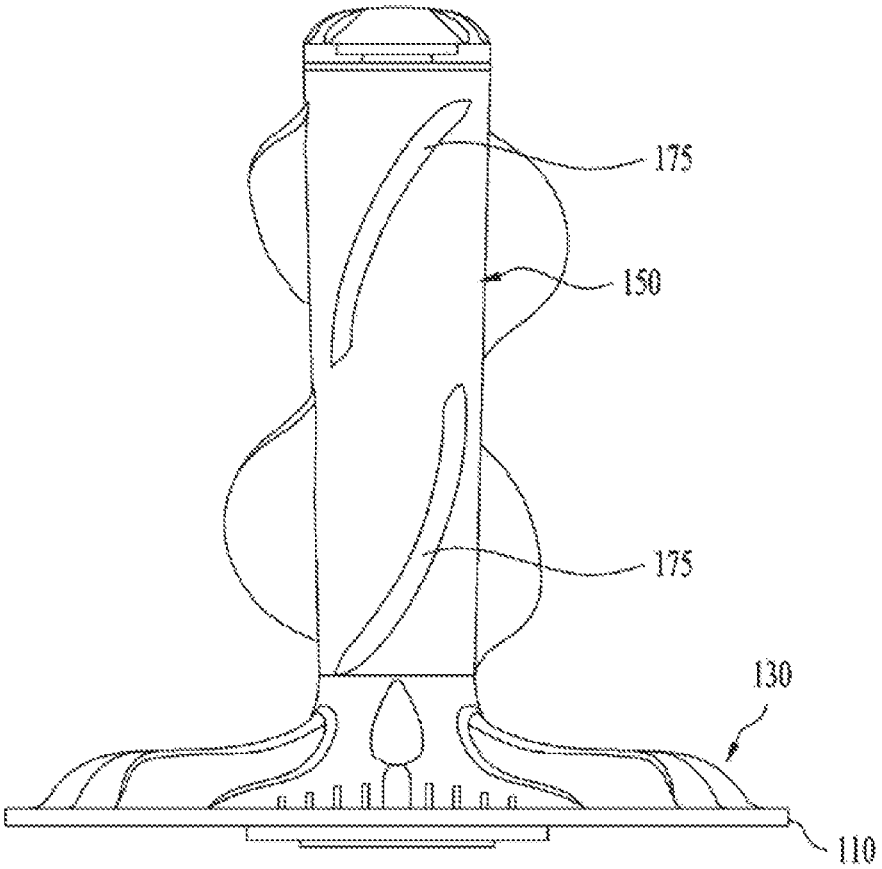
FIG. 4 is a view showing a blade composed of a plurality of divided bodies in a laundry treating apparatus according to another embodiment of the present disclosure.

In one example, another embodiment of the present disclosure is shown in FIG. 4. Referring to FIG. 4, in another embodiment of the present disclosure, the blade 170 may be composed of a plurality of divided bodies 175 separated from each other between said one end 171 and the other end 173.

In another embodiment of the present disclosure, a resistance of water acting on the blade 170 during the rotation of the rotator 100 may be reduced. Accordingly, a load of the driver 50 with respect to the rotation of the rotator 100 may be reduced.

FIG. 4 shows a state in which one blade 170 is composed of two divided bodies 175 according to another embodiment of the present disclosure. However, in FIG. 4, the two divided bodies 175 positioned in a line in a vertical direction do not constitute one blade 170 together. In FIG. 4, a divided body 175 located above corresponds to an upper portion of one blade 170, and a divided body 175 located below corresponds to a lower portion of a blade 170 adjacent to said one blade 170.

In the present disclosure, the blade 170 may be integrally formed or composed of the plurality of divided bodies 175 in consideration of a load of the driver 50, a washing efficiency, and the like that are typically expected in the laundry treating apparatus 1.

Figure 5:
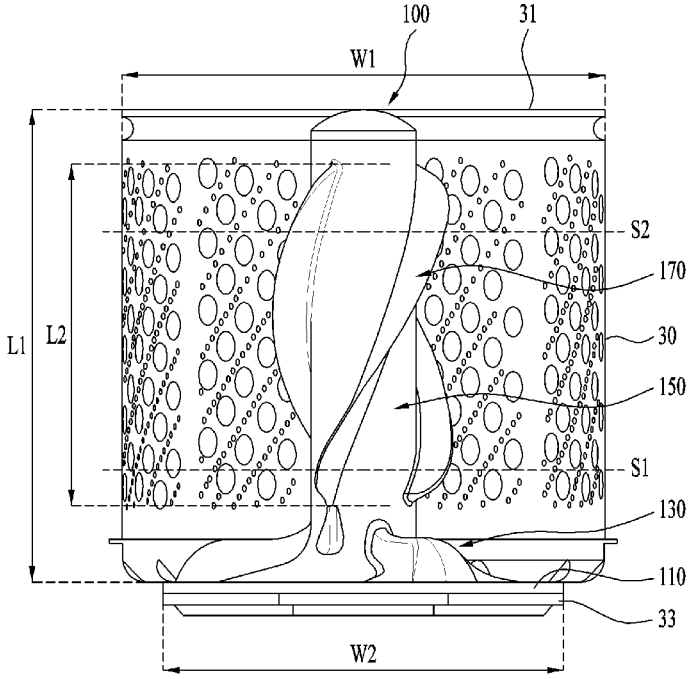
FIG. 5 is a view showing a drum and a rotator in a laundry treating apparatus according to an embodiment of the present disclosure.

In one example, FIG. 5 shows the rotator 100 disposed inside the drum 30 according to an embodiment of the present disclosure.

A length L1 of the pillar 150 may be related to a washing performance and the load of the driver 50. For example, when the length L1 of the pillar 150 is increased, the washing performance may be improved, but an excessive load may be applied to the driver 50. When the length L1 of the pillar 150 is reduced, the load on the driver 50 may be reduced, but the washing performance may also be reduced.

Considering the above relationship, one embodiment of the present disclosure may determine a ratio between the length L1 of the pillar 150 and a diameter W2 of the bottom portion 110. When the length L1 of the pillar 150 is too small, and when an amount of water supplied is large because of a large amount of laundry, because an area in which the water flow is formed by the pillar 150 and the blade 170 is reduced, the washing performance may be deteriorated.

When the length L1 of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

In addition, the bottom portion 110 contributes to the formation of the water flow as a protrusion 130 or the like is formed thereon as will be described below. Therefore, the relationship between lengths of the bottom portion 110 and the pillar 150 determines an effect of the water flow by the bottom portion 110 and an effect of the water flow by the pillar 150.

With respect to various diameters W2 of the bottom portion 110 and lengths L1 of the pillar 150, ascending and descending of the laundry with the water may take place effectively when the length L1 of the pillar 150 is 0.8 times the diameter W2 of the bottom portion 110, and the load of the driver 50 with respect to the rotation of the rotator 100 may be properly maintained when the length L1 of the pillar 150 is equal to or less than 1.2 times the diameter W2 of the bottom portion 110.

The diameter W2 of the bottom portion 110 may be variously determined in consideration of a diameter of the pillar 150, sizes of the tub 20 and the drum 30 of the laundry treating apparatus 1, a capacity of the laundry allowed in the laundry treating apparatus 1, an amount of water supplied resulted therefrom, and the like.

The length L1 of the pillar 150 may be variously determined in consideration of a diameter W1 of the drum 30 as well as a height of the drum 30, a diameter of the pillar 150, an inclination angle A of the blade 170, and the like.

One embodiment of the present disclosure determines an allowable ratio between the length L1 of the pillar 150 and the diameter W2 of the bottom portion 110. Accordingly, the rotator 100 in which the load of the driver 50 is within an allowable range while the formation of the water flow by the pillar 150 is effectively achieved may be implemented.

In one example, in one embodiment of the present disclosure, the diameter W2 of the bottom portion 110 may be equal to or greater than 0.7 times and equal to less than 0.9 times the diameter W1 of the drum 30. However, the present disclosure is not necessarily limited thereto.

Because the bottom portion 110 is positioned on the bottom surface 33 of the drum 30 and rotated, the diameter W2 of the bottom portion 110 with respect to the diameter W1 of the drum 30 needs to be considered. When the diameter W2 of the bottom portion 110 is too small, the effect of the water flow by the rotation of the bottom portion 110 may be too small. When the diameter W2 of the bottom portion 110 is too large, it is easy to cause jamming of the laundry and is disadvantageous in the rotation by the load of the driver 50 and the like.

Considering the above relationship, in one embodiment of the present disclosure, the diameter W2 of the bottom portion 110 is equal to or greater than 0.7 times the diameter W1 of the drum 30, which allows the effect of the water flow by the rotation of the bottom portion 110 with respect to an entirety of the drum 30 to be effective. In addition, the diameter W2 of the bottom portion 110 is equal to or less than 0.9 times the diameter W1 of the drum 30, which prevents the jamming of the laundry and minimizes the load of the rotation.

The diameter W1 of the drum 30 may be variously determined in consideration of the capacity of the laundry allowed in the laundry treating apparatus 1, the amount of water supplied, and a relationship with the tub 20.

In one example, in one embodiment of the present disclosure, the blade 170 may have a height L2 from said one end 171 to the other end 173 in the longitudinal direction L of the pillar 150 equal to or greater than 0.5 times the total height L1 of the pillar 150.

Figure 6A:
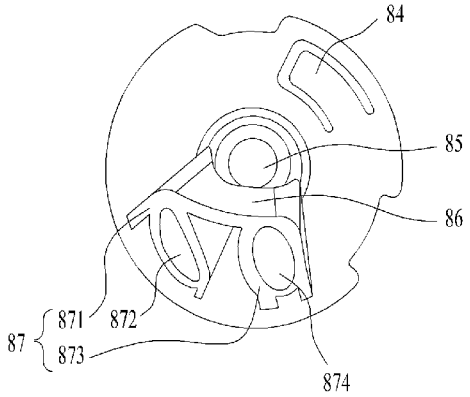
FIGS. 6A-6C show a sprayer according to an embodiment of the present disclosure.
Figure 6B:
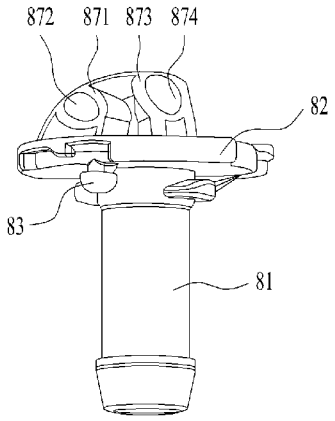
Figure 6C:
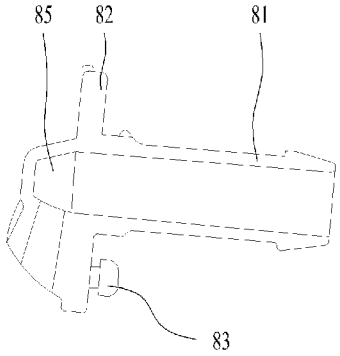

A vertical level L4 of said one end 171 and a vertical level of the other end 173 of the blade 170 may be defined as vertical distances from a top surface of the bottom portion 110 as shown in FIGS. 5 and 6. The height L2 from said one end 171 to the other end 173 of the blade 170 may be defined as the height of the blade 170.

The height L2 of the blade 170 may be determined in consideration of a relationship between an ascending amount and a descending amount of the water flow by the blade 170 and the load of the driver 50.

For example, as the height L2 of the blade 170 becomes smaller, the area in which the blade 170 is formed may be reduced, and the ascending amount and the descending amount of the water flow may be reduced.

In addition, as the height L2 of the blade 170 becomes greater, a water flow forming force may become stronger, but the load of the driver 50 may be increased. In addition, the height L2 of the blade 170 may be related to the inclination angle A of the blade 170, the diameter of the pillar 150, and the like.

In one embodiment of the present disclosure, the height L2 of the blade 170 may be equal to or greater than 0.5 times the length L1 of the pillar 150. Accordingly, in one embodiment of the present disclosure, the blade 170 may form an ascending water flow and a descending water flow effective inside the drum 30 effective when the pillar 150 rotates. When the height L2 of the blade 170 is less than 0.5 times the length L1 of the pillar 150, it may be difficult to effectively form the water flow by the blade 170.

The height L2 of the blade 170 may be variously determined based on the size of the drum 30, the diameter W2 of the bottom portion 110, the height L1 of the pillar 150, the height of the protrusion 130, the position of the cap 165, and the like.

In one example, in one embodiment of the present disclosure, the blade 170 may have a length L3 extending from said one end 171 to the other end 173 along an extension direction equal to or greater than 1.4 times and equal to or less than 1.8 times the height L2 from said one end 171 to the other end 173 with respect to the longitudinal direction L of the pillar 150. However, this means an optimal design value, and the present disclosure is not necessarily limited thereto.

The length L3 extending from said one end 171 to the other end 173 along the extension direction of the blade 170 may be defined as an extension length of the blade 170, and the height L2 from said one end 171 to the other end 173 of the blade 170 may be defined as a height of the blade 170.

For example, when the number of turns that the blade 170 is wound on the pillar 150 at the same height L2 of the blade 170 is increased, the extension length L3 of the blade 170 is increased.

When the extension length L3 of the blade 170 with respect to the height L2 of the blade 170 becomes larger, a contact area between the blade 170 and the water may increase and the inclination angle A of the blade 170 may be increased. Thus, an influence of the water flow formation on the water may be increased, but the load of the driver 50 may also be increased.

On the other hand, when the extended length L3 of the blade 170 is excessively reduced, the load of the driver 50 may be reduced, but a water flow forming ability may be excessively reduced, thereby reducing the washing efficiency.

In one embodiment of the present disclosure, the extension length L3 of the blade 170 may be equal to or greater than 1.4 times the height L2 of the blade 170 to secure the inclination angle A of the blade 170 for effectively forming the water flow and to effectively secure the contact area between the blade 170 and the water.

In addition, in one embodiment of the present disclosure, the extension length L3 of the blade 170 may be equal to or less than 1.8 times the height L2 of the blade 170, which may be advantageous for formation of a rotational water flow by the blade 170 while the load of the driver 50 does not deviate from an allowable range.

The extension length L3 of the blade 170 may be variously determined based on the height L2 of the blade 170, the diameter of the pillar 150, the inclination angle A of the blade 170, a load amount of the driver 50, a water flow formation level, and the like.

In one example, one embodiment of the present disclosure may include the water supply 60 and the controller 70 as described above. The water supply 60 may be constructed to supply the water into the tub 20, and the controller 70 may control the water supply 60 in the washing process to adjust the amount of water supplied.

The controller 70 may control the water supply 60 such that the amount of water supplied preset based on an amount of laundry selected by the user through the manipulation unit in the washing process is supplied into the tub 20.

For example, when the user selects a minimum amount as the amount of laundry or when the amount of laundry is identified to be the minimum amount through a sensor or the like, a minimum amount of water supplied corresponding to the minimum amount of laundry may be preset in the controller 70, and the controller 70 may control the water supply 60 such that the minimum amount of water supplied is supplied into the tub 20.

In addition, when the amount of laundry is identified as a maximum amount by the user, the sensor, or the like, a maximum amount of water supplied corresponding to the maximum amount of laundry may be preset in the controller 70, and the controller 70 may control the water supply 60 such that the maximum amount of water supplied is supplied into the tub 20.

There may be various minimum criteria for the amount of laundry. For example, in a standard washing capacity test in the United States, an amount of laundry of 3 kg or an amount of laundry of 8 lb is presented as a small amount criteria. In one embodiment of the present disclosure, the minimum amount of water supplied may be an amount of water supplied preset for the laundry amount corresponding to 8 lb. In addition, there may be various maximum criterion for the amount of laundry.

In one embodiment of the present disclosure, a water surface S1 corresponding to the minimum amount of water supplied and a water surface S2 corresponding to the maximum amount of water supplied are shown in FIG. 5. Referring to FIG. 5, in one embodiment of the present disclosure, the controller 70 may control the water supply 60 such that the amount of water supplied is equal to or greater than the preset minimum amount of water supplied in the washing process, and the blade 170 may be constructed such that the vertical level L4 of said one end 171 with respect to the bottom portion 110 is equal to or lower than a vertical level of the water surface S1 corresponding to the minimum amount of water supplied.

When the blade 170 is not submerged in the water, even when the rotator 100 rotates, the ascending water flow and the descending water flow by the blade 170 are not formed, which is disadvantageous. Therefore, in one embodiment of the present disclosure, in the washing process, at least the minimum amount of water supplied may be supplied into the tub 20, and said one end 171 of the blade 170 may be positioned at a vertical level equal to or lower than the vertical level of the water surface S1 corresponding to the preset minimum amount of water supplied such that the blade 171 may be always positioned at a vertical level equal to or lower than a vertical level of a water surface and submerged in the water despite a change in the amount of water supplied.

The minimum amount of water supplied may be the amount of water supplied for the amount of laundry of 8 lb, which is a criteria of a small load test in the authorized laundry test in the United States, as described above.

In one example, in one embodiment of the present disclosure, a height L4 of said one end of the blade 170 may be equal to or less than 0.25 times the diameter W1 of the drum 30. This means an optimal design value and the present disclosure is not necessarily limited thereto.

One embodiment of the present disclosure allows said one end 171 of the blade 170 to be always submerged in the water in the washing process or the rinsing process, so that the water flow formation effect by the rotation of the rotator 100 may occur effectively. To this end, the height L4 of said one end 171 of the blade 170 may be designed to be 0.25 times the diameter W1 of the drum 30.

The vertical level L4 of said one end 171 of the blade 170 may be specifically determined based on the minimum amount of water supplied and the diameter W1 of the drum 30. For example, the larger the minimum amount of water supplied, the higher the vertical level L4 of said one end 171 of the blade 170 may be determined. In addition, the larger the diameter W1 of the drum, the lower the vertical level L4 of said one end 171 of the blade 170.

In one embodiment of the present disclosure, the minimum amount of water supplied may be the amount of water supplied for the amount of laundry of 8 lb as described above. Considering the diameter W1 of the drum 30 that is usually determined therefor, the height L4 of said one end 171 of the blade 170 may be equal to or less than 0.25 times the diameter W1 of the drum 30, and the vertical level L4 may be lower than the vertical level of the water surface S1.

When the height L4 of said one end 171 of the blade 170 exceeds 0.25 times the diameter W1 of the drum 30, the diameter W1 of the drum 30 must be smaller than necessary in order for the vertical level L4 of said one end 171 of the blade 170 to be lower than the vertical level of the water surface S1 of the minimum amount of water supplied. In this case, an allowable amount of laundry in the laundry treating apparatus 1 may be excessively reduced, which may be disadvantageous.

When the pillar 150 protrudes upward from the bottom portion 110 as shown in FIG. 5, the vertical level L4 of said one end 171 of the blade 170 may correspond to a distance from the bottom portion 110 in a vertical upward direction.

In one embodiment of the present disclosure, as the height L4 of said one end 171 of the blade 170 is equal to or less than 0.25 times the diameter W1 of the drum 30, even at the minimum amount of water supplied, said one end 171 of the blade 170 is able to be in contact with the water and at the same time, the diameter W1 of the drum 30 is able to be sufficiently secured, which may be advantageous for the washing performance.

In one example, in an embodiment of the present disclosure, as for the blade 170, said one end 171 may be located below a water surface of the water stored in the tub 20 and the other end 173 may be located above the water surface in the washing process.

In FIG. 5, the vertical level of the water surface S1 at the minimum amount of water supplied and the vertical level of the water surface S2 at the maximum amount of water supplied, according to an embodiment of the present disclosure are indicated. FIG. 5 shows that said one end 171 of the blade 170 is located at a vertical level closer to the bottom portion 110 than the vertical level of the water surface S1 based on the minimum amount of water supplied, and the other end 173 of the blade 170 is located at a vertical level further from the bottom portion 110 than the vertical level of the water surface S2 based on the maximum amount of water supplied.

In one embodiment of the present disclosure, the other end 173 of the blade 170 is disposed to be spaced apart from the water surface of the water stored in the tub 20 toward the open surface 31 at all times, so that the water flow by the blade 170 may always be formed up to an upper portion of the water even when the amount of water stored in the tub 20 is changed in the washing process.

The position of the other end 173 of the blade 170 may be determined in consideration of various factors such as the diameter W1 of the drum 30, the maximum amount of water supplied, the length L1 of the pillar 150, and the like.

In one example, in the laundry treating apparatus 1 according to one embodiment of the present disclosure, the controller 70 may control the water supply 60 such that the amount of water supplied is equal to or less than the preset maximum amount of water supplied in the washing process. In addition, the blade 170 may be constructed such that the vertical level of the other end 173 with respect to the bottom portion 110 may be equal to or higher than the vertical level of the water surface S2 corresponding to the maximum amount of water supplied.

The amount of water supplied to the tub 20 may vary based on the amount of laundry or the result of manipulation of the manipulation unit by the user. One embodiment of the present disclosure allows the other end 173 of the blade 170 to be located at the vertical level equal to or higher than the vertical level of the water surface S2 even for the maximum amount of water supplied that may be provided to the tub 20 in the washing process, so that the water flow by the blade 170 may be formed up to the upper portion of the water stored in the tub 20 even when the amount of water supplied is changed.

FIG. 6 shows a sprayer according to an embodiment of the present disclosure. (a) in FIG. 6 is a front view of the sprayer, (b) in FIG. 6 is a bottom view of the sprayer, and (c) in FIG. 6 is a side cross-sectional view of the sprayer.

Referring to (a), (b), and (c) in FIG. 6, the sprayer 80 may include a nozzle supply pipe 81 connected to the water supply 60 to receive water from the water supply 60, and a nozzle assembly 87 coupled to the nozzle supply pipe 81 to spray water supplied through the nozzle supply pipe 81 into the drum 30.

The nozzle supply pipe 81 may be coupled through the laundry inlet 12. The nozzle supply pipe 81 may pass through the laundry inlet 12, so that one end thereof may be connected to the water supply 60. Water supplied from the water supply 60 may be supplied to the sprayer 80 through the nozzle supply pipe 81. However, it is also possible that the nozzle supply pipe 81 does not pass through the laundry inlet 12, but the water supply 60 passes through the laundry inlet 12 to be coupled to the nozzle supply pipe 81. Various structures in which the nozzle supply pipe 81 may be supplied with water from a water supply source through the water supply 60 may be applied.

The water supplied to the nozzle supply pipe 81 may flow to the nozzle assembly 87 along the nozzle supply pipe 81. A nozzle branch 85 may be formed at one end of the nozzle supply pipe 81 located on a side away from the water supply 60. Water passing through the nozzle branch 85 may flow along the nozzle assembly 87. With the nozzle branch 85 as a base point, the nozzle assembly 87 may include a first nozzle 871 and a second nozzle 873 for separating the flow of water in different directions. A direction of the water flowing along the nozzle supply pipe 81 may be abruptly changed from the nozzle branch 85 as the base point. For example, water flowing in a direction parallel to the ground in the nozzle supply pipe 81 may flow in a direction perpendicular to the ground while passing through the nozzle branch 85. Because the above case is merely an example, water may flow in various paths and directions.

Because the first nozzle 871 and the second nozzle 873 guide the water in different directions, the first nozzle 871 and the second nozzle 873 may be formed to be spaced apart from each other. The first nozzle 871 and the second nozzle 873 may receive an external force and a vibration resulted from a flow of fluid generated therein, and thus structural stability thereof may be low. In order to improve the structural stability as described above, a nozzle connection portion 86 for connecting the first nozzle 871 and the second nozzle 873 from the front may be formed. The nozzle connecting portion 86 may support the first nozzle 871 and the second nozzle 873 from the outside without affecting internal flow paths and the flow of the fluid of the first nozzle 871 and the second nozzle 873.

A sprayer mounting portion 82 may be disposed between the nozzle supply pipe 81 and the nozzle branch 85. The sprayer mounting portion 82 may be manufactured in a circular shape having a diameter greater than a diameter of a flow path of the nozzle supply pipe 81. The sprayer mounting portion 82 may extend radially from one end of the nozzle supply pipe 81 to reinforce a strength of coupling with the top surface 11 of the cabinet. There is an effect of increasing a friction surface with the top surface 11 of the cabinet by increasing a cross-sectional area.

The sprayer mounting portion 82 may increase the friction surface with the top surface 11 of the cabinet, as well as provide a surface on which another coupling structure is formed. An elastic protrusion 84 formed to have an elastic force in a front and rear direction of the sprayer mounting portion 82 may be disposed on one side of the sprayer mounting portion 82. The elastic protrusion 84 may be coupled to a coupling groove defined in the top surface 11 of the cabinet. When the elastic protrusion 84 is inserted into the coupling groove and rotated to a coupling position, the elastic force of the elastic protrusion allows the sprayer mounting portion 82 to be firmly coupled to the top surface 11 of the cabinet.

On a rear surface of the sprayer mounting portion 82, a coupling protrusion 83 may be formed to protrude rearward from the rear surface of the sprayer mounting portion 82. The coupling protrusion 83 may be formed to be inserted into the coupling groove defined in the top surface 11 of the cabinet. In the coupling protrusion 83, a portion extending from the rear surface of the sprayer mounting portion 82 may have a small cross-sectional area, and a protrusion portion may have a large cross-sectional area. The coupling groove defined in the top surface 11 of the cabinet into which the coupling protrusion 83 is inserted is defined such that the coupling protrusion 83 may be inserted therein. A width of the groove may be reduced along a rotation direction of the coupling protrusion 83. Therefore, when the coupling protrusion 83 is initially inserted into the coupling groove, the coupling protrusion 83 may be easily inserted or withdrawn. However, when rotating the coupling protrusion 83 along the coupling groove after inserting the coupling protrusion 83 into the coupling groove, because of a difference in cross-sectional area between the coupling groove and the coupling protrusion 83, the coupling protrusion 83 may not be easily withdrawn from the coupling groove. This scheme allows the sprayer mounting portion 82 to be coupled to the top surface 11 of the cabinet. That is, the sprayer 80 may be more firmly coupled to the top surface 11 of the cabinet.

The sprayer 80 may be rigidly coupled to the top surface 11 of the cabinet as described above. However, without being limited to being coupled to the top surface 11 of the cabinet, the sprayer 80 may be coupled to various locations capable of spraying water into the drum 30. As a method for strengthening the coupling, the elastic protrusion 84 or the coupling protrusion 83 may be used.

The nozzle assembly 87 will be described. The nozzle assembly 87 may include the first nozzle 871 and the second nozzle 873 that spray the water in the different directions. When it is required to spray the water in various directions, the nozzle assembly 87 may be constructed to have the various number of nozzles without being limited to the first nozzle 871 and the second nozzle 873.

The first nozzle 871 and the second nozzle 873 may have a first spray hole 872 and a second spray hole 874 through which the water is sprayed, respectively. Water that has passed through the first spray hole 872 or the second spray hole 874 may be introduced into the drum 30 under an influence of inertia and gravity.

The water sprayed through the first spray hole 872 and the second spray hole 874 may be sprayed in different directions. The water that has passed through the first spray hole 872 or the second spray hole 874 may be affected by various external forces such as the gravity in addition to a spraying force of spraying the water. Accordingly, straightness of the sprayed water may be deteriorated. In addition, because a radial resistance disappears when the sprayed water passes through the spray hole, the sprayed water expands in the radial direction as a distance from the spray hole increases. Therefore, when the sprayed water reaches an object, the water may reach a larger area than the spray hole.

As described above, the water may be sprayed in the different directions through the first spray hole 872 and the second spray hole 874. In this connection, the spray direction may mean a direction of a velocity of a fluid passing through the spray hole at a time of passage. That is, when the spray hole is viewed as a plane, it may mean an average of vector values of velocities of water particles existing on the corresponding plane.

In addition, when the first spray hole 872 or the second spray hole 874 is viewed as a plane, the spray direction may mean a direction normal to the plane. A normal line means a line perpendicular to a specific plane.

In the present specification, the spray direction may mean a direction of a normal line extending from a center of gravity of the spray hole as described above.

As mentioned above, the first nozzle and the second nozzle may spray the water supplied from the water supply 60 through the nozzle supply pipe 81 in the different spray directions. In addition, beyond simply spraying the water in the different directions, the first nozzle and the second nozzle may spray the water in different directions based on the pillar 150 installed inside the drum 30.

When the pillar 150 is viewed from the sprayer 80, the first nozzle 871 may spray the water toward a portion the drum 30 located on a left side of the pillar 150, and the second nozzle may spray the water toward a portion of the drum 30 located on a right side of the pillar 150. The present disclosure may not be limited thereto, and the first nozzle 871 may spray the water toward a space on a right side of the pillar 150, and the second nozzle 873 may spray the water toward a space on a left side of the pillar 150. A spray direction in which each nozzle sprays the water may be appropriately selected.

As described above, when the first nozzle 871 sprays the water toward the space on the left side of the pillar 150, the sprayed water may reach the bottom surface 33 of the drum or an inner peripheral surface of the drum 30 and be scattered. The scattered water may reach the space on the right side of the pillar 150. However, in the present specification, when spraying the water in a specific direction, the specific direction will mean the direction at the time when the water passes through the spray hole or the direction of the normal line extending from the center of gravity of the spray hole as mentioned above. The location where the sprayed water reaches may be understood independently of the spray direction.

That is, based on the pillar 150, the first nozzle 871 and the second nozzle 873 spray the water into the different spaces of the drum 30, so that the water may be sprayed more evenly inside the drum 30. When spraying the water evenly inside the drum 30, a phenomenon in which the water is concentrated in a specific portion, and accordingly, washing and rinsing efficiencies are reduced may be prevented.

Figure 7A:
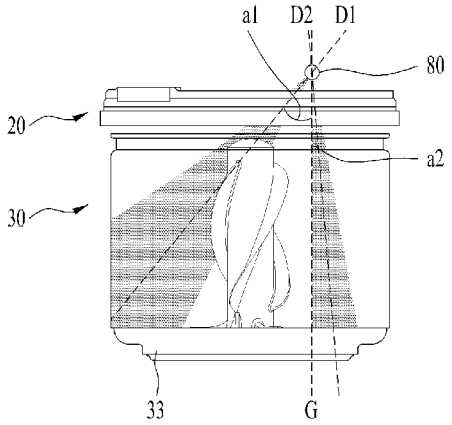
FIGS. 7A-7C are a view showing a state in which water is sprayed from a sprayer into a drum according to an embodiment of the present disclosure.
Figure 7B:
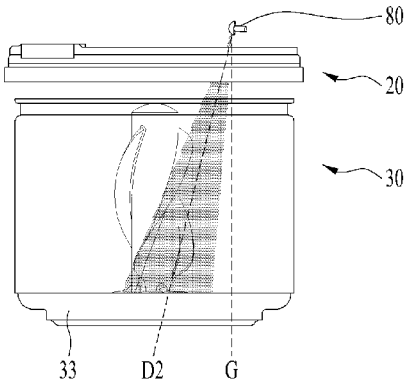
Figure 7C:
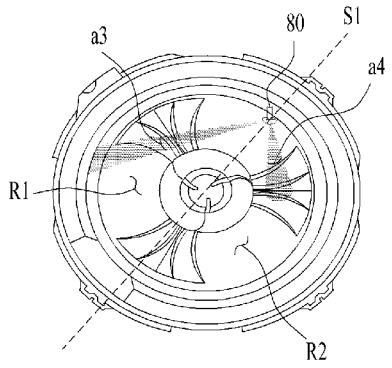

(a), (b), and (c) in FIG. 7 represent a spray pattern of water sprayed from a sprayer according to an embodiment of the present disclosure. (a) in FIG. 7 is a front view of the spray pattern, (b) in FIG. 7 is a side view of the spray pattern, and (c) in FIG. 7 is a top view of the spray pattern.

Assuming a virtual plane S1 connecting the pillar 150 with the sprayer 80 referring to (c) in FIG. 7, an inner space of the drum 30 may be divided into a first drum space R1 and a second drum space R2 divided by the virtual plane S1. When dividing the interior of the drum 30 as such, the first nozzle 871 and the second nozzle 873 may spray the water supplied through the nozzle supply pipe 81 to different spaces. As described above, the sprayer 80 may spray the water in various ways, but the water may not be sprayed on the pillar 150 and the blade 170 installed inside the drum 30. It may be designed that the water sprayed from the nozzle assembly 87 is not sprayed toward the pillar 150 or the blade 170, and it may be designed that the water that has passed through the first spray hole 872 and the second spray hole 874 reaches the interior of the drum 30 without reaching the pillar 150 and the blade 170.

However, even in such case, the water sprayed from the sprayer 80 may bounce off the inner circumferential surface of the drum 30 or the bottom surface 33 of the drum to reach the pillar 150 or the blade 170. In the present specification, "spraying the water by avoiding the pillar 150 or the blade 170" may include a case in which the water sprayed primarily to components, such as the drum 30, other than the pillar 150 and the blade 170 is reflected and scattered to reach the pillar 150 or the blade 170.

Referring to FIG. 6 and (a) in FIG. 7, the first nozzle 871 constituting the nozzle assembly 87 of the sprayer 80 according to an embodiment of the present disclosure may spray the water supplied through the nozzle supply pipe 81 in a direction toward the circumferential surface of the drum 30. In addition, the second nozzle 873 may spray the water supplied through the nozzle supply pipe 81 in the direction toward the bottom surface 33 of the drum.

As described above, the direction toward the circumferential surface may mean a direction in which a straight line perpendicular to the first spray hole 872 extends from a center of the first spray hole 872 defined at the end of the first nozzle 871. The direction toward the bottom surface 33 of the drum, which is the direction of the water sprayed from the second nozzle 873, may also be understood in the same manner.

(a), (b), and (c) in FIG. 7 show only the drum 30, the rotator 100, an upper portion of the tub 20, and the sprayer 80, except for the other components of the laundry treating apparatus 1, and show the spray pattern of the water sprayed from the sprayer 80.

The spray pattern of the water sprayed from the first nozzle 871 formed at a left portion of the sprayer 80 will be described with reference to FIG. 6 and (a) in FIG. 7. A center line of the spray pattern is shown to face towards the inner circumferential surface of the drum 30. The center line may mean the direction toward the inner circumferential surface of the drum mentioned above. As may be seen in (a) in FIG. 7, the water sprayed in the direction toward the inner circumferential surface of the drum may not only reach the inner circumferential surface of the drum 30, but may also reach the bottom surface 33 of the drum or the bottom portion 110 of the rotator 100. However, based on the definition of the spray direction described above, it may be understood that the first nozzle sprays the water supplied through the nozzle supply pipe 81 toward the inner circumferential surface of the drum 30.

Referring to FIG. 6 and (c) in FIG. 7, it may be seen that the water sprayed from the first nozzle 871 and the second nozzle 873 is sprayed into the drum while avoiding the pillar 150 and the blade 170.

In other words, the first nozzle 871 and the second nozzle 873 may spray the water into the inside of the drum 30, and more specifically, spray the water into the space except for the pillar 150 and the blade 170. Because the space inside the drum 30 is defined by the bottom surface 33 of the drum and the inner circumferential surface of the drum 30, the space except for the pillar 150 and the blade 170 may be specified.

Referring back to (a) in FIG. 7, it may be seen that the water sprayed through the second nozzle 873 formed on a right portion of the sprayer 80 is sprayed toward the bottom surface 33 of the drum. A direction in which an imaginary line perpendicular to a center of the second spray hole 874 defined at the end of the second nozzle 873 extends may be understood as the direction toward the bottom surface 33 of the drum. As may be seen in (a) in FIG. 7, the water may be sprayed from the second nozzle 873 in the direction toward the bottom surface 33 of the drum, and the sprayed water may not be directly sprayed on the inner circumferential surface of the drum 30. However, the presents disclosure is not limited thereto. It may be understood that "spraying the water in the direction toward the bottom surface 33 of the drum" is a concept including a case in which the water is initially sprayed from the second nozzle 873 toward the bottom surface 33 of the drum, and then sprayed to the inner circumferential surface of the drum 30 during the flow of water.

As described above, when the first nozzle 871 and the second nozzle 873 constituting the nozzle assembly 87 are designed to spray the water in the direction toward the inner circumferential surface of the drum 30 and in the direction toward the bottom surface 33 of the drum, in the process of using the laundry treating apparatus, the water may be supplied from various directions to the clothes accommodated in the drum 30. When spraying the water in the direction toward the inner circumferential surface of the drum 30, the water may directly reach a relatively high position of the drum 30. In addition, by spraying water toward the inner circumferential surface of the drum 30, even when the clothes inside the drum 30 are filled up to a certain vertical level, the water may be effectively supplied to the bottom surface 33 of the drum along an inner wall of the drum 30.

Because the second nozzle 873 sprays the water in two directions toward the bottom surface 33 of the drum, when the clothes are stored in the drum 30 over a certain level, the sprayed water does not effectively reach clothes stored adjacent to the bottom surface 33 of the drum. Therefore, when a large amount of clothes are stored as described above, it may be effective for the washing and the rinsing to spray the water in the direction toward the inner circumferential surface of the drum 30.

On the other hand, when a small amount of clothes are stored inside the drum 30, when the water is sprayed onto the inner circumferential surface of the drum 30, the water may not be sprayed directly onto the stored clothes. Because the water sprayed onto the inner circumferential surface of the drum 30 primarily reaches the inner wall of the drum 30 and loses momentum, a rinsing effect may be reduced compared to a case in which the water is directly sprayed onto the clothes. In such a case, the second nozzle 873 that directly sprays the water in the direction toward the bottom surface 33 of the drum may perform the washing and rinsing processes more effectively.

That is, as the first nozzle 871 sprays the water in the direction of the inner circumferential surface of the drum and the second nozzle 873 sprays the water in the direction of the bottom surface 33 of the drum, the washing and the rinsing may be properly performed not only in the case in which the small amount of clothes are stored in the drum 30, but also in the case in which the large amount of clothes are stored.

In one example, an area of the first spray hole 872 defined at the end of the first nozzle 871 may be larger than an area of the second spray hole 874 defined at the end of the second nozzle 873. The water branching from the nozzle branch 85 and flowing may flow more toward one of the first nozzle 871 and the second nozzle 873 having a flow path with a larger volume. Therefore, it may be designed that more water is supplied from the first nozzle 871. Lengths of the first nozzle 871 and the second nozzle 873 may be similar to each other because of structural characteristics of the sprayer 80. Therefore, an amount of water to be sprayed may be adjusted using a difference in the area of the first spray hole 872 and the second spray hole 874. It is possible to increase the area of the first spray hole 872 in order to increase a flow rate in the first nozzle 871.

However, the present disclosure is not limited thereto. When it is designed that the second nozzle 873 sprays more water, the area of the second spray hole 874 may be larger than the area of the first spray hole 872.

In one example, a first angle a1, which is an angle between a first spray direction D1, which is the direction in which the water is discharged from the center of the first spray hole, and a reference direction, which is a direction in which the water freely falls, may be greater than a second angle a2, which is an angle between a second spray direction D2, which is the direction in which the water is discharged from the center of the second spray hole, and the reference direction. The reference direction G may be understood as a direction of gravity.

As described above, the first spray direction D1 and the second spray direction D2 may be defined as the directions of water passing through the first spray hole 872 and the second spray hole 874, respectively. The water may be sprayed over a larger area as the angle formed with the reference direction, which means the direction of gravity, is larger. That is, it is designed that the first angle a1 is larger than the second angle a2, so that the first nozzle 871 may spray the water on a larger area than the second nozzle 873. However, the present disclosure is not limited thereto, and the second nozzle 873 may spray the water on a larger area than the first nozzle 871 when necessary. In other words, it may be designed that a specific nozzle sprays water on a larger area than other nozzles rather than the plurality of nozzles spray water on the same area. As such, the sprayer 80 may improve washing and rinsing performances by spraying the water in various patterns.

Referring to (c) in FIG. 7, the spray pattern of the water sprayed from the sprayer is shown at a top. An angle formed by a pattern of water sprayed from the first nozzle 871 located at the left portion of the sprayer 80 may be defined as a first spray angle a3, and an angle formed by a pattern of water sprayed from the second nozzle 873 located at the right portion of the sprayer 80 may be defined as a second spray angle a4.

Depending on the first spray angle a3 and the second spray angle a4, the sprayed water may be sprayed avoiding the pillar 150 and the blade 170, or sprayed to reach the pillar 150 and the blade 170.

The first spray angle a3 and the second spray angle a4 may be appropriately selected in a design process. As the first spray angle a3 and the second spray angle a4 are larger, the water may be sprayed over a larger area, increasing the effect of washing and rinsing. However, when the first spray angle a3 and the second spray angle a4 become excessively large, because the water is sprayed within a limited space, it is inevitable that the water is sprayed onto the pillar 150 and the blade 170.

Accordingly, the first spray angle a3 and the second spray angle a4 may be appropriately adjusted based on the positions of the first nozzle 871 and the second nozzle 873.

In addition, a first spray amount that is an amount of water sprayed during a reference time from the first spray hole may be greater than a second spray amount that is an amount of water sprayed during the reference time from the second spray hole. The first spray amount may mean a volume of water sprayed per second, and $m^3/s$, $cm^3/s$, $mm^3/s$, or the like may be used as a unit. As described above, by spraying the water into the drum 30 in the various patterns by setting an amount of spray from each nozzle differently, the washing and rinsing effects may be improved.

Figure 8B:
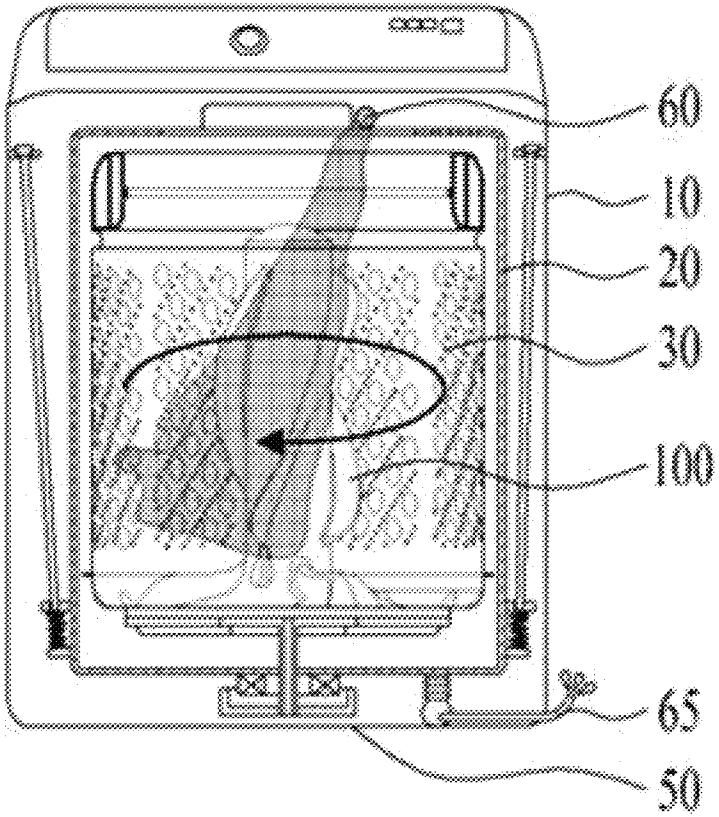
FIGS. 8A-8B are a view showing a rinsing process of a conventional laundry treating apparatus.
Figure 8A:
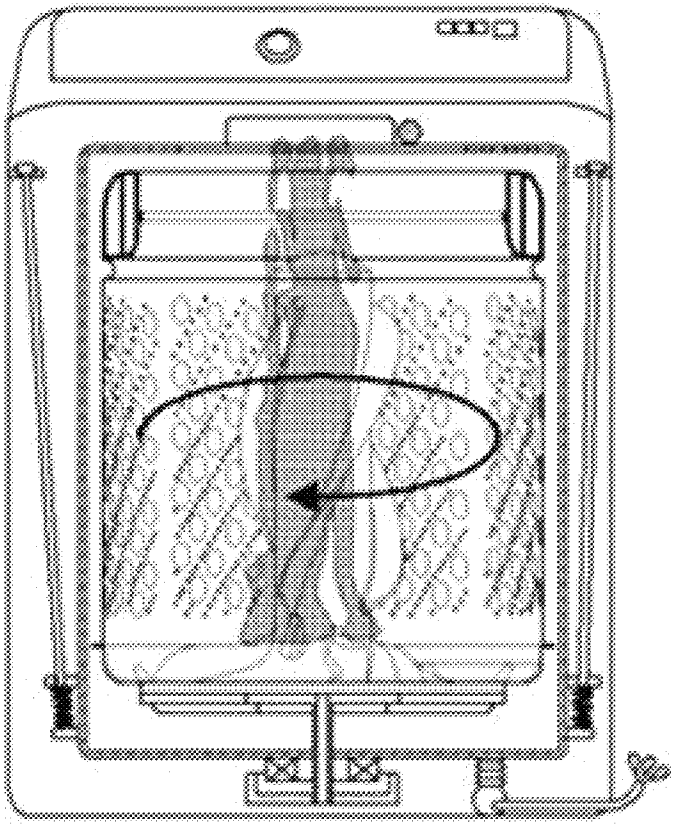

FIG. 8 is a view showing a rinsing scheme, which is a scheme of spraying water, among rinsing schemes of a conventional laundry treating apparatus.

Specifically, (a) in FIG. 8 is a view showing that the water is supplied in the tub 20, and (b) in FIG. 8 is a view showing that a rinsing process is performed while spraying the water.

Briefly describing the conventional rinsing schemes, the conventional rinsing schemes may be divided into a scheme (deep rinse) of storing the water and performing the rinsing, and a scheme (jet spray) of performing the rinsing while spraying the water.

In the rinsing scheme of the deep rinse scheme, the rinsing process is performed after injecting the water into the tub 20 to an extent that the clothes are immersed.

In the case of the deep rinse scheme, when there is no big restriction on an amount of water used, there is no big problem in the water supply, but because the water must be supplied to have a certain water level in tub 20, there is a problem that an amount of water required increases as a size of the tub 20 increases. In addition, as the amount of supplied water increases, it takes a long time for water supply and drainage.

In addition, because agitation must be performed after the water supply, damage to the cloth may be greater. However, nevertheless, there is an advantage that the rinsing performance is excellent.

On the other hand, in the case of the jet spray scheme of spraying the water, the rinsing is performed by spraying the water from a detergent inlet and a separate nozzle while dehydration is in progress.

In the case of the jet spray scheme, unlike the deep rinse scheme, there is advantages that the amount of water used is small and it takes less time, but there is a disadvantage that the rinsing performance is lower than that in the deep rinse scheme.

Specifically, in the case of the conventional jet spray scheme, a fabric softener is supplied with water, and the spray of water is performed along with the dehydration process.

The rinsing scheme of the jet spray scheme is implemented as a water flow passes through the cloth during the dehydration process to cause the rinsing. The water is sprayed when the drum 30 is rotated at an rpm equal to or higher than about 120 RPM to generate a centrifugal force of a level equal to or higher than a certain level.

In the case of such a jet spray scheme, the drainage is opened to prevent a phenomenon in which drainage does not occur as the RPM is lowered.

It is necessary for the drainage to be maintained in the opened state to perform the dehydration and the rinsing, but it is difficult to expect the rinsing effect.

Figure 9:
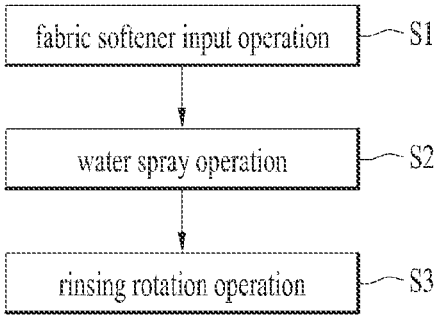
FIG. 9 is a view showing a method for controlling a laundry treating apparatus according to an embodiment.
Figure 10C:
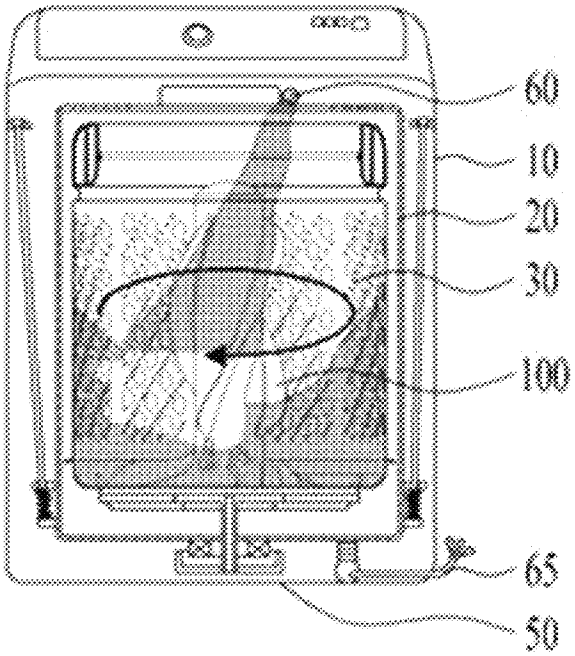
FIGS. 10A-10C are an operation diagram of a control method illustrated in FIG. 9.
Figure 10B:
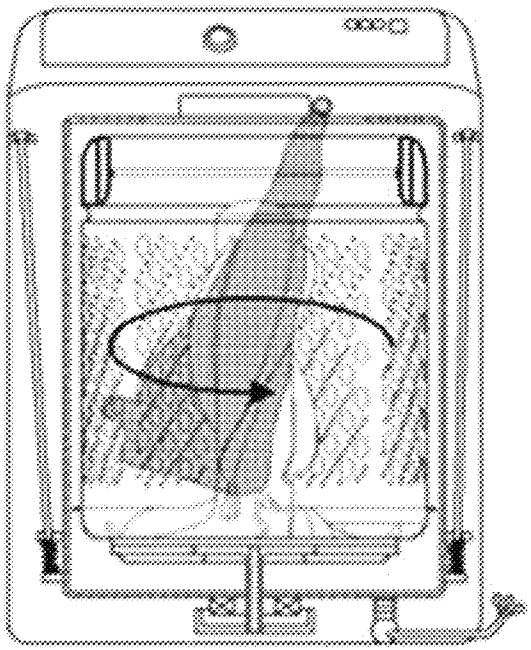
Figure 10A:
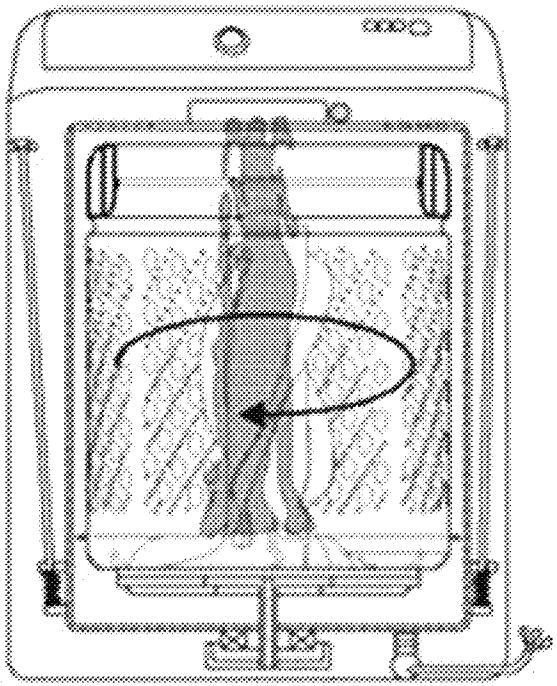
Figure 11:
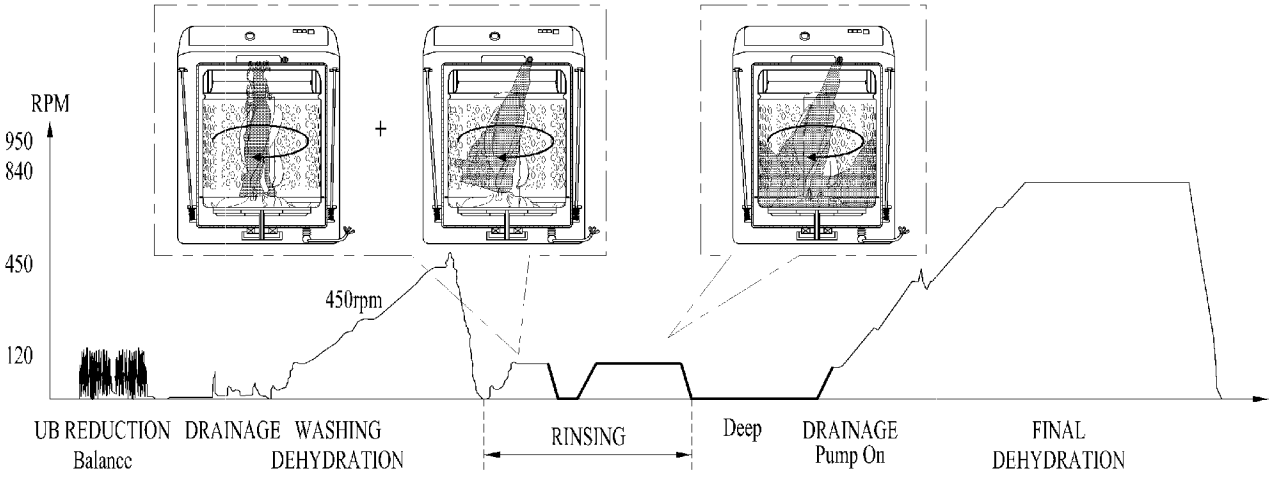
FIG. 11 is a view showing a series of washing processes of a laundry treating apparatus according to an embodiment.

FIG. 9 is a view showing a method for controlling a laundry treating apparatus according to an embodiment, FIG. 10 is an operation diagram of a control method illustrated in FIG. 9, and FIG. 11 is a view showing a series of washing processes of a laundry treating apparatus according to an embodiment.

(a) in FIG. 10 is a view showing a fabric softener input operation, (b) in FIG. 10 is a view showing a water spray operation, and (c) in FIG. 10 is a view showing a rinsing rotation operation.

Hereinafter, a rinsing process and a series of washing processes of the laundry treating apparatus will be described with reference to FIGS. 9 to 11.

The method for controlling the laundry treating apparatus according to an embodiment of the present disclosure may include a fabric softener input operation (S1), a water spray operation (S2), and a rinsing rotation operation (S3).

The fabric softener input operation (S1) may be performed after the washing process is terminated. Specifically, at an end of the washing process, an UB reduction algorithm for reducing unbalance operates, and an after washing-dehydration process operates after the drainage is performed. After the after washing-dehydration process stops at 0 rpm after dehydrating residual detergent and moisture remaining on the fabric while operating at a high rpm, the rinsing process according to an embodiment of the present disclosure begins.

The fabric softener input operation (S1) is an operation in which the fabric softener is input into drum 30 through the water provided from the water supply 60.

As described above, the detergent feeder may accommodate therein the detergent for the washing, the fabric softener to soften the cloth, and the like. In addition, the detergent feeder may be constructed such that the fabric softener is introduced into the drum 30 through the water provided from the water supply 60.

The fabric softener input operation (S1) may be terminated when the input of the fabric softener is completed.

Also, in the fabric softener input operation (S1), the drum 30 and the rotator 100 may be rotated for the agitation of the clothes. When the drum 30 and the rotator 100 are rotated even in the fabric softener input operation (S1), it is possible to prevent the fabric softener from sticking to only a portion while the cloth is agitated.

When the fabric softener input operation (S1) is terminated, the water spray operation (S2) may be performed. The water spray operation (S2) may be an operation in which the water is sprayed from the sprayer 80 into the drum.

Specifically, the water spray operation (S2) is an operation in which the water is sprayed into the tub 20 or the drum 30 through the sprayer 80 with the drainage 65 closed.

That is, the sprayer 80 may spray the water into at least one of a space between the tub 20 and the drum 30 and the inner space of the drum 30. Even in the water spray operation (S2), the drum 30 and the rotator 100 may be rotated.

The fact that the drum 30 and the rotator 100 are rotated even in the water spray operation (S2) is for allowing the cloth to be fully wetted. In this connection, the drum 30 and the rotator 100 may be rotated in the same direction.

In the water spray operation (S2), the drainage 65 may remain closed. This is to prevent the water input through the sprayer 80 from being discharged to the outside of the cabinet 10.

The rinsing rotation operation (S3) may be an operation in which the drum 30 and the rotator 100 are rotated in the same direction while the water is continuously sprayed from the sprayer 80.

The rotator 100 may be controlled such that a first rotation forming an ascending water flow and a second rotation forming a descending water flow are alternately performed.

That is, in the rinsing rotation operation (S3), the rinsing of the cloth may be performed evenly as the drum 30 and the rotator 100 are rotated in the same direction to disperse the clothes.

The drum 30 and the rotator 100 may be controlled such that the RPM thereof is varied in the rinsing rotation operation (S3). Specifically, the drum 30 and the rotator 100 may be controlled such that the RPM thereof varies in a range from 60 to 120 RPM depending on a load.

More specifically, the RPM of the drum 30 and the rotator 100 may be repeatedly increased and decreased. When the increase and the decrease of the RPM is repeatedly performed, a phenomenon in which the drum 30 is filled with water (a phenomenon in which the RPM is lowered without the drainage) may be prevented.

That is, when the agitation of the drum 30 and the rotator 100 is performed when the water is sprayed from sprayer 80 in the state in which the drainage 65 is closed, an effect similar to that of the deep rinse scheme is exhibited, so that the rinsing performance may be improved.

Unlike the deep rinse scheme, in the case of the jet spray scheme, the rinsing is performed by a centrifugal force. The rinsing performance is lowered in a case of cloth located at a lower portion or heavy cloth. On the other hand, according to the method for controlling the laundry treating apparatus according to an embodiment of the present disclosure, the rinsing performance may be improved as the drainage 65 is closed despite supplying the water using the sprayer 80.

In the rinsing rotation operation (S3), the drum 30 and the rotator 100 may be rotated in the same direction, and the rotator 100 may be controlled in a scheme in which the first rotation is performed first and then the second rotation is performed.

The RPM of the drum 30 and the rotator 100 may be lower in the rinsing rotation operation (S3) than in the dehydration operation. Because the rinsing rotation operation (S3) is not an operation of removing the moisture from the cloth, but is a process of removing foreign substances remaining in the cloth and softening the cloth, the drum 30 and the rotator 100 do not need to be rotated at the high RPM as in the dewatering process.

The rinsing rotation operation (S3) may be performed for a longer time than a time required for the fabric softener input operation (S1) and the water spray operation (S2). This is because the water level in the drum 30 may continuously increase as the rinsing rotation operation (S3) is performed.

After the rinsing rotation operation (S3) is completed, the drainage may proceed. After the drainage proceeds, the dehydration operation may be performed. Specifically, after the washing process is completed, a process for reducing the unbalance may be performed. After the wash water is drained, a washing dehydration process may be performed. When the washing dehydration process is terminated, the rinsing process according to the present disclosure may be performed.

As the rinsing rotation operation (S3) is performed, unnecessary waste water may be saved and an effect of the fabric softener may be maximized. Therefore, less water may be used than in the deep rinse scheme, and higher rinsing performance and effect may be obtained than in the jet spray scheme.

Although representative embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of rights of the present disclosure should not be limited to the described embodiment and should be defined by the claims described later as well as the claims and equivalents.

What is claimed is:

1. A method for controlling a laundry treating apparatus including a cabinet, a tub configured to receive water, a drum that is rotatably disposed inside the tub and has an open surface configured to receive clothes therethrough and a bottom surface located at an opposite side of the open surface, the drum being configured to rotate about a vertical rotation axis, a rotator that is rotatably disposed at the bottom surface of the drum and includes a bottom portion rotatably disposed on the bottom surface of the drum, a pillar protruding from the bottom portion toward the open surface, and a plurality of blades spaced apart from one another along a circumferential direction of the pillar and inclined with respect to a longitudinal direction of the pillar, a water supply configured to supply water into the tub, a sprayer configured to receive water from the water supply and to spray the water into the drum, a drainage configured to discharge the water in the tub to an outside of the cabinet, a motor configured to generate rotational force, a gear set that is configured to simultaneously or selectively transmit the rotational force from the motor to the drum and the rotator, and a controller configured to control (i) rotation directions of the drum and the rotator by controlling the gear set, (ii) operation of the water supply and the drainage, and (iii) and a washing course including at least one of a water supplying operation, a washing operation, a rinsing operation, or a dehydration operation, the method comprising:

performing the rinsing operation, wherein the rinsing operation comprises:

supplying a fabric softener into the drum with the water supplied from the water supply;

after completion of supplying the fabric softener into the drum, spraying water into the drum through the sprayer in a state in which the drainage is closed; and rotating the drum and the rotator in a same direction while spraying the water through the sprayer in the state in which the drainage is closed.

2. The method of claim 1, wherein rotating the drum and the rotator comprises:

varying a revolutions per minute (RPM) of each of the drum and the rotator.

3. The method of claim 2, wherein rotating the drum and the rotator comprises:

performing a first rotation operation for generating an ascending water flow in the drum;

after the first rotation operation, performing a second rotation operation for generating a descending water flow in the drum; and alternating the first rotation operation and the second rotation operation.

4. The method of claim 3, wherein performing the first rotation operation comprises rotating the drum and the rotator in a first direction, and wherein performing the second rotation operation comprises rotating the drum and the rotator in a second direction opposite to the first direction.

5. The method of claim 2, wherein varying the RPM comprises:

increasing the RPM of each of the drum and the rotator; and decreasing the RPM of each of the drum and the rotator.

6. The method of claim 5, wherein varying the RPM further comprises:

alternating increasing and decreasing the RPM of each of the drum and the rotator.

7. The method of claim 1, further comprising:

performing a drain operation and a dehydration operation after rotating the drum and the rotator in the same direction.

8. The method of claim 1, further comprising:

performing a first drain operation and a first dehydration operation before rotating the drum and the rotator in the same direction; and performing a second drain operation and a second dehydration operation after rotating the drum and the rotator in the same direction, wherein a first revolutions per minute (RPM) of the drum in the first dehydration operation is less than a second RPM in the second dehydration operation.

9. The method of claim 8, wherein rotating the drum and the rotator comprises:

rotating the drum and the rotator in the same direction at an RPM that is less than the first RPM and the second RPM.

10. The method of claim 1, wherein rotating the drum and the rotator comprises:

controlling a driver configured to rotate the drum and the rotator.

* * * * *